US011631528B2

(12) United States Patent
Kitashima

(10) Patent No.: US 11,631,528 B2
(45) Date of Patent: Apr. 18, 2023

(54) INDUCTOR

(71) Applicant: Murata Manufacturing Co., Ltd., Kyoto-fu (JP)

(72) Inventor: Yuki Kitashima, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 537 days.

(21) Appl. No.: 16/776,415

(22) Filed: Jan. 29, 2020

(65) Prior Publication Data

US 2020/0265993 A1 Aug. 20, 2020

(30) Foreign Application Priority Data

Feb. 20, 2019 (JP) ..... JP2019-028494

(51) Int. Cl.
*H01F 27/29* (2006.01)
*H01F 41/10* (2006.01)
(Continued)

(52) U.S. Cl.
CPC ..... *H01F 27/292* (2013.01); *H01F 1/20* (2013.01); *H01F 17/04* (2013.01);
(Continued)

(58) Field of Classification Search
CPC ..... H01F 27/292; H01F 1/20; H01F 17/04; H01F 41/0246; H01F 41/10; H01F 2017/048
See application file for complete search history.

(56) References Cited

U.S. PATENT DOCUMENTS 8,695,209 B2 * 4/2014 Saito ..... H01F 27/292 29/841
10,079,089 B1 * 9/2018 Yoon ..... H01F 27/2804
(Continued)

FOREIGN PATENT DOCUMENTS

CN 105845318 A 8/2016
CN 109378182 A * 2/2019 ..... H01F 27/255
(Continued)

OTHER PUBLICATIONS

An Office Action; "Notice of Reasons for Refusal," mailed by the Japanese Patent Office dated Sep. 21, 2021, which corresponds to Japanese Patent Application No. 2019-028494 and is related to U.S. Appl. No. 16/776,415 with English translation.

*Primary Examiner* — Jeffrey T Carley
(74) *Attorney, Agent, or Firm* — Studebaker & Brackett PC

(57) ABSTRACT

The inductor includes a coil including a winding portion formed by winding a conductor wire having an insulating coating and lead-out portions extended from the winding portion, and a body made of a magnetic portion including magnetic powder and resin, and containing the coil, and outer electrodes on a body surface. The body includes a mounting surface, an upper surface opposite the mounting surface, a pair of opposing end surfaces adjacent to the mounting and upper surfaces, and a pair of opposing side surfaces adjacent to the mounting surface, the upper surface, and the end surfaces. End portions of the lead-out portions respectively have a flat portion exposed from the body surface, a covered portion adjacent to the flat portion at at least one of the end portions covered with the magnetic portion, and the flat portion is electrically connected to the outer electrode.

10 Claims, 5 Drawing Sheets

(51) Int. Cl.
*H01F 17/04* (2006.01)
*H01F 41/02* (2006.01)
*H01F 1/20* (2006.01)

(52) U.S. Cl.
CPC ..... *H01F 41/0246* (2013.01); *H01F 41/10* (2013.01); *H01F 2017/048* (2013.01)

(56) References Cited

U.S. PATENT DOCUMENTS 11,133,126 B2 * 9/2021 Jang ..... H01F 17/0013
2008/0036566 A1 * 2/2008 Klesyk ..... H01F 27/292 29/605
2013/0307655 A1 * 11/2013 Saito ..... H01F 27/292 336/83
2014/0338185 A1 * 11/2014 Muneuchi ..... H01F 41/066 29/605
2014/0366365 A1 * 12/2014 Sasamori ..... H01F 41/0246 29/605
2016/0012962 A1 * 1/2016 Lee ..... H01F 27/292 427/116
2016/0217914 A1 * 7/2016 Kim ..... B22F 7/08
2016/0225516 A1 8/2016 Kitamura
2017/0084385 A1 * 3/2017 Ida ..... H01F 27/292
2017/0133143 A1 * 5/2017 Maeda ..... H01F 41/0246
2018/0247764 A1 8/2018 Muneuchi et al.
2018/0308609 A1 * 10/2018 Shinohara ..... H01F 1/15333
2020/0090850 A1 * 3/2020 Isobe ..... H01F 17/04
2020/0312531 A1 * 10/2020 Okuizumi ..... H01F 41/061

FOREIGN PATENT DOCUMENTS

JP 2013-183052 A 9/2013
JP 2014-175437 A 9/2014
JP 2016-146476 A 8/2016
JP 2017-201718 A 11/2017
WO 2017/135058 A1 8/2017

* cited by examiner

INDUCTOR

CROSS-REFERENCE TO RELATED APPLICATION

This application claims benefit of priority to Japanese Patent Application No. 2019-028494, filed Feb. 20, 2019, the entire content of which is incorporated herein by reference.

BACKGROUND

Technical Field

The present disclosure relates to an inductor.

Background Art

Japanese Unexamined Patent Application Publication No. 2017-201718 describes a surface mount inductor including a coil formed by winding a conductor wire, and a molded body in which the coil is sealed with a sealing material containing a metal magnetic substance powder and a resin. On a surface of the molded body, an end portion of a lead-out portion of the coil is exposed, and a plated layer made of a conductive material constituting an outer electrode is formed at and around the end portion of the lead-out portion. The plated layer forms the outer electrode connected to the end portion of the lead-out portion of the coil.

Generally, an insulating coating is provided on a conductor wire forming a coil. Thus, in order to connect the outer electrode and the end portion of the lead-out portion of the coil, it is necessary to form the outer electrode to be connected to the end portion of the lead-out portion of the coil, after removing the insulating coating. However, when the insulating coating is removed by a laser or the like, a residue of the insulating coating may be generated, or the insulating coating may be removed more than necessary and a groove may be formed. In such case, an electrically discontinuous portion is large between the end portion of the lead-out portion and the metal magnetic substance powder on the surface of the molded body. The plated layer may need to be thicker than necessary in order to form the outer electrode that connects, even when such discontinuous portion exists, the end portion of the lead-out portion to the metal magnetic substance powder on the surface of the molded body.

SUMMARY

Accordingly, the present disclosure provides an inductor in which occurrence of connection failure between a coil and an outer electrode is suppressed even when a plated layer is thin.

An inductor includes a coil including a winding portion formed by winding a conductor wire having an insulating coating and lead-out portions extended from the winding portion, a body made of a magnetic portion including a magnetic powder and a resin, and containing the coil, and outer electrodes disposed on a surface of the body. The body includes a mounting surface, an upper surface opposite the mounting surface, a pair of end surfaces disposed adjacent to the mounting surface and the upper surface and opposite to each other, and a pair of side surfaces disposed adjacent to the mounting surface, the upper surface, and the end surfaces and opposite to each other. End portions of the lead-out portions respectively have a flat portion exposed from the surface of the body, a covered portion adjacent to the flat portion at at least one of the end portions covered with the magnetic portion, and the flat portion is electrically connected to the outer electrode.

Other features, elements, characteristics and advantages of the present disclosure will become more apparent from the following detailed description of preferred embodiments of the present disclosure with reference to the attached drawings.

DETAILED DESCRIPTION

Figure 1:
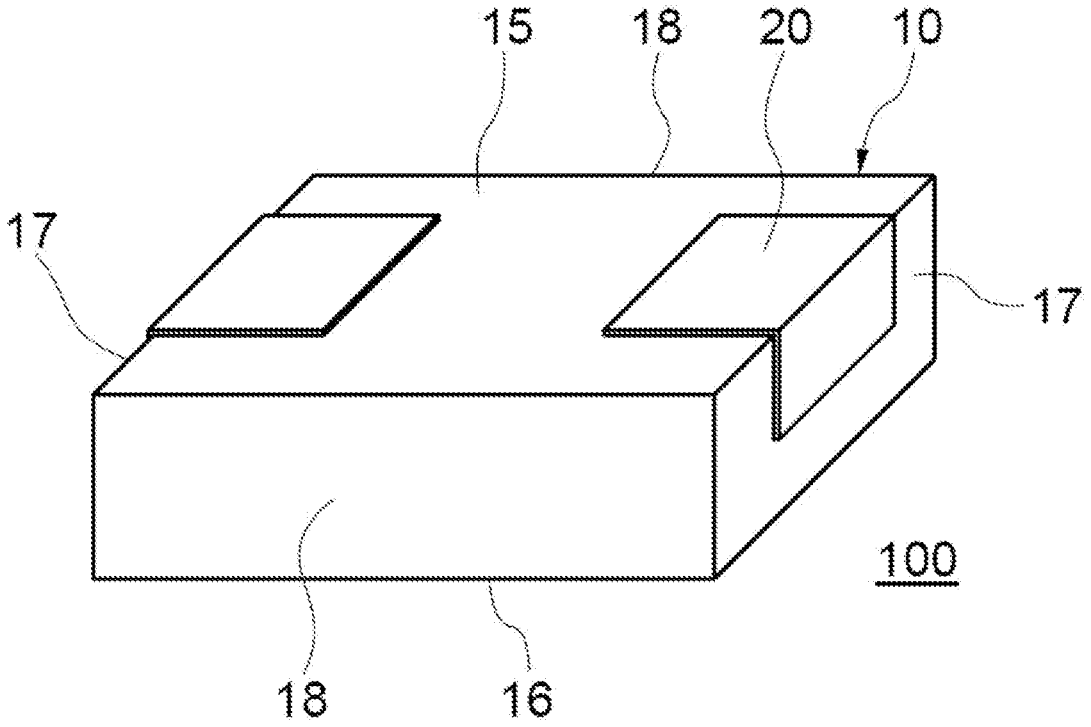
FIG. 1 is a perspective view of an inductor according to Example 1 as viewed from a side of a mounting surface.

An inductor includes a coil including a winding portion formed by winding a conductor wire having an insulating coating and lead-out portions extended from the winding portion, and a body made of a magnetic portion including a magnetic powder and a resin, and containing the coil, and externals terminal disposed on a surface of the body. The body includes a mounting surface, an upper surface opposite the mounting surface, a pair of end surfaces disposed adjacent to the mounting surface and the upper surface, and opposite to each other, and a pair of side surfaces disposed adjacent to the mounting surface, the upper surface, and the end surfaces, and opposite to each other. End portions of the lead-out portions respectively have a flat portion exposed from the surface of the body, a covered portion adjacent to the flat portion at at least one of the end portions covered with the magnetic portion. The flat portion of the end portions of the lead-out portions is electrically connected to the outer electrode.

The end portions of the lead-out portion of the coil have the flat portion exposed from the surface of the body, the covered portion adjacent to the flat portion at at least one of the end portions covered with the magnetic portion. Accordingly, it is possible to suppress a residue being generated when the insulating coating of the conductor wire is removed, and to suppress a groove being generated due to excessive removal of the insulating coating. As a result, for example, when the outer electrode is formed by a plating process, occurrence of connection failure between the coil and the outer electrode is suppressed even when a plated layer is thin. In addition, when the plating process is performed by barrel plating, it is possible to reduce a plating time, and it is possible to reduce influence on an external resin film provided on the body. Further, an allowable range of conditions for removing the insulating coating of the conductor wire can be wider, and further productivity can be improved.

At least part of the covered portion may be disposed further inside the body than the flat portion. At the end portions of the lead-out portions, at least one edge portion of the covered portion in a width direction of the conductor wire is disposed further inside the body than the flat portion. This makes it possible to form the covered portion more easily. Further, the allowable range of the conditions can be wider for removing the insulating coating of the conductor wire, and the productivity can be improved further.

The magnetic powder includes metal magnetic substances, and at least some of the metal magnetic substances on the surface of the body where a plated layer is formed may be melted and fused to each other. When the insulating coating of the conductor wire is removed by, for example, laser irradiation, at least some of the metal magnetic substances disposed on the surface of the body are melted and fused to each other. Thereby, adhesion of the plated layer to the surface of the body is improved. Further, a growth rate of the plated layer is improved.

A winding axis of the winding portion may be disposed so as to intersect the mounting surface, and flat portions at the end portion of the lead-out portion may be exposed from the end surfaces, of the body, opposite to each other. Since the coil is disposed so that the end portions of the lead-out portions is exposed from the end surface of the body, the lead-out portions can be easily exposed from the body, and further, the productivity is improved.

A winding axis of the winding portion may be disposed substantially parallel to the mounting surface, and flat portions at the end portion of the lead-out portion may be exposed from the mounting surface. Accordingly, the lead-out portions can be directly exposed from the mounting surface, so that the inductor can be made to have small DC resistance and can support a large current.

The winding portion may be disposed so that a winding axis intersects the mounting surface, and flat portions at the end portion of the lead-out portion may be exposed from the mounting surface. Accordingly, the outer electrode can be formed only on the mounting surface, so that the inductor can be made to have small DC resistance and can support high-density implementation.

A term "step" as used herein includes, not only an independent step, but also a step that cannot be clearly distinguished from other steps, as long as a desired purpose of the step is achieved. Hereinafter, embodiments of the present disclosure are described based on the accompanying drawings. However, the embodiments described below illustrate an inductor for embodying a technical idea of the present disclosure, and the present disclosure is not limited to inductors described below. Note that, members described in the claims are not limited to members of the embodiments. In particular, dimensions, materials, shapes, relative arrangements, and the like of constituent elements described in the embodiments are not intended to limit the scope of the present disclosure, and are merely illustrative, unless otherwise specified. Note that, in the drawings, the same reference numerals are given to the same parts. While the embodiments are illustrated individually for convenience in view of ease of explanation or understanding of the gist, partial substitutions or combinations of structures described in the different embodiments are possible. In Example 2 and subsequent Examples, description of common matters to those in Example 1 is omitted, and only different points are described. In particular, similar effects with a similar configuration are not described for each embodiment.

EXAMPLES

Example 1

Figure 2:
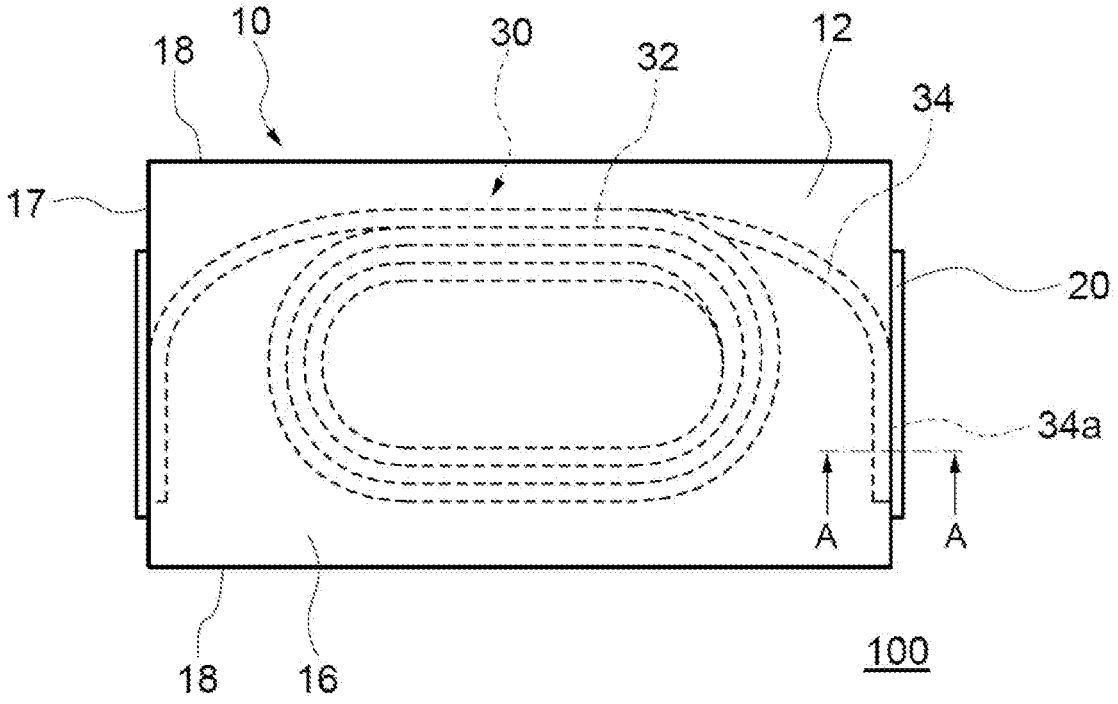
FIG. 2 is a partial see-through plan view of the inductor according to Example 1 as viewed from a side of an upper surface.

An inductor 100 according to Example 1 is described with reference to FIG. 1 to FIG. 3. FIG. 1 illustrates a schematic perspective view of the inductor 100 as viewed from a side of a mounting surface. FIG. 2 is a schematic partial see-through plan view of the inductor 100 as viewed from an upper surface side opposite the mounting surface.

As illustrated in FIG. 1 and FIG. 2, the inductor 100 includes a coil 30, a body 10 made of a magnetic portion 12 containing a magnetic powder and a resin, and containing the coil 30, and a pair of outer electrodes 20 disposed on a surface of the body 10 and electrically connected to the coil 30. The body 10 includes a mounting surface 15, an upper surface 16 opposite the mounting surface 15, a pair of end surfaces 17 disposed adjacent to the mounting surface 15 and the upper surface 16, and opposite to each other, and a pair of side surfaces 18 disposed adjacent to the mounting surface 15, the upper surface 16, and the end surfaces 17, and opposite to each other.

As the magnetic powder constituting the magnetic portion 12, an iron-based metal magnetic powder, such as Fe, Fe—Si—Cr, Fe—Ni—Al, Fe—Cr—Al, Fe—Si, Fe—Si—Al, Fe—Ni, or Fe—Ni—Mo, a metal magnetic powder having other compositions, a metal magnetic powder such as amorphous, a metal magnetic powder in which a surface is covered with an insulator such as glass, a metal magnetic powder having a modified surface, and a nano-level fine metal magnetic powder are used. Further, as the resin, a thermosetting resin, such as an epoxy resin, a polyimide resin, or a phenol resin, and a thermoplastic resin, such as a polyethylene resin or a polyamide resin are used.

The outer electrode 20 has an L-shaped section and is disposed across the mounting surface 15 and the end surface 17. As illustrated in FIG. 2, the coil 30 includes a winding portion 32 and a pair of lead-out portions 34, each of the lead-out portions 34 being extended from an outermost periphery of the winding portion 32. An end portion of the lead-out portion 34 is electrically connected to the outer electrode 20. Although not illustrated, the surface of the body 10 except for a portion where the outer electrode 20 is provided is covered with an external resin film.

The winding portion 32 of the coil 30 has an insulating coating, and for example, is formed by winding a conductor wire having a substantially rectangular section (rectangular wire) such that both ends thereof are located at the outermost periphery, to form two tiers, that is, upper and lower tiers, in a state of being connected to each other at an innermost periphery (alpha winding). The winding portion 32 is disposed so that a winding axis thereof intersects the mounting surface 15 at a substantially right angle, and is contained in the body 10. The lead-out portion 34 is extended from an outermost periphery of each tier of the winding portion 32 toward the end surface 17 of the body 10, and the end portion of the lead-out portion 34 is disposed along the end surface 17. A flat portion 34*a* is provided on a conductor wire portion on a side of the end surface 17 of the end portion of the lead-out portion 34, and at least part of the flat portion 34*a* is exposed from the end surface 17, and is electrically connected to the outer electrode 20. A cross-section orthogonal to a length direction of the conductor wire is, for example, substantially rectangular, and is defined by a width corresponding to a long side of a substantially rectangular shape and a thickness corresponding to a short side of the substantially rectangular shape.

The conductor wire has a width of, for example, about 120 μm or more and about 350 μm or less (i.e., from about 120 μm to about 350 μm), and a thickness of, for example, about 10 μm or more and about 150 μm or less (i.e., from about 10 μm to about 150 μm). In addition, an insulating coating of the conductor wire is formed of an insulating resin such as polyamide imide having a thickness of, for example, about 2 μm or more and about 10 μm or less (i.e., from about 2 μm to about 10 μm), and preferably about 6 μm. A self-fusion layer containing a self-fusing component such as a thermoplastic resin or a thermosetting resin may be further provided on a surface of the insulating coating, and may be formed to have a thickness of about 1 μm or more and about 3 μm or less (i.e., from about 1 μm to about 3 μm).

Figure 3:
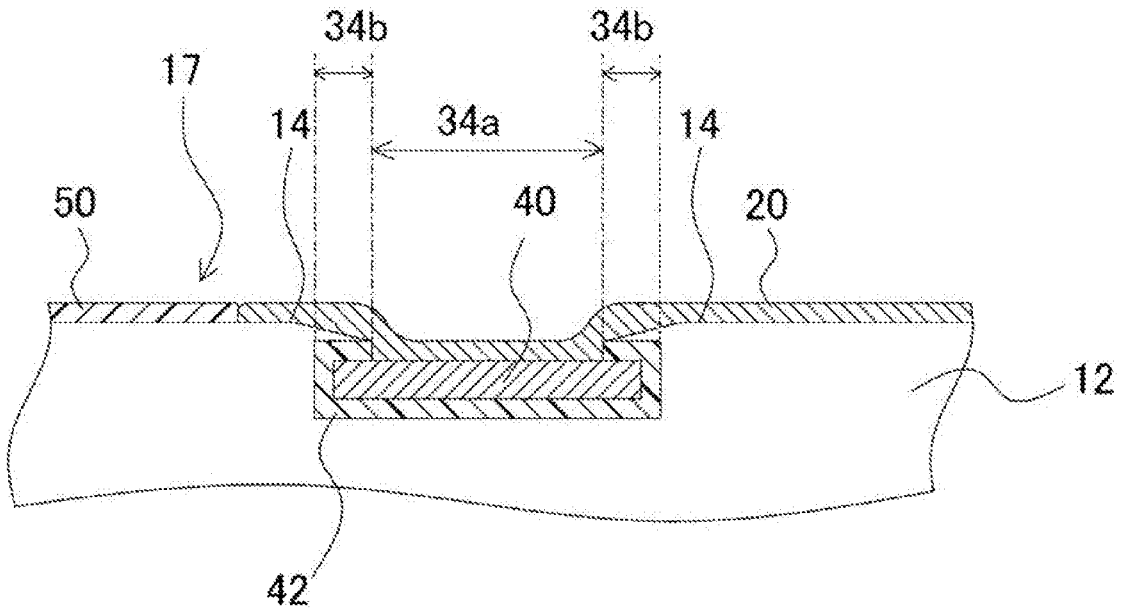
FIG. 3 is a partial enlarged view of a section along line A-A in FIG. 2.

FIG. 3 is a partial enlarged view of a vicinity of the outer electrode in a schematic section along line A-A in FIG. 2. As illustrated in FIG. 3, the end portion of the lead-out portion 34 is embedded in the magnetic portion 12 along the end surface 17 of the body 10. The side of the end surface 17 of the end portion of the lead-out portion 34 has the flat portion 34*a* from which the insulating coating is peeled off and a conductor wire 40 is exposed, and a covered portion 34*b* on which the insulating coating is covered with the magnetic portion 12. The covered portions 34*b* are provided on both edge portions of the flat portion 34*a* in a width direction of the conductor wire respectively, so as to be continuous with the flat portion 34*a*. The outer electrode 20 is formed by plating across the flat portion 34*a* and a surface 14 of the body 10 around the flat portion 34*a*, and the surface of the body 10 except for a portion where the outer electrode is provided is covered with an external resin film 50. A ratio of a length of the flat portion 34*a* to the width of the conductor wire is, for example, about 0.5 or more and about 0.9 or less (i.e., from about 0.5 to about 0.9), and a ratio of sum of respective lengths of the covered portions 34*b* to the width of the conductor wire is about 0.1 or more and about 0.5 or less (i.e., from about 0.1 to about 0.5), for example. Note that, the flat portion 34*a* is embedded further inside the body 10 than the end surface 17, and the covered portion 34*b* is covered with the magnetic portion 12 when the inductor is viewed from a direction orthogonal to the end surface 17.

Next, an example of a method for manufacturing the inductor 100 is described with reference to FIG. 4A to FIG. 4D. The method for manufacturing the inductor includes, for example, a coil preparing step, a body molding step, an external resin film forming step, a peeling step, and an outer electrode forming step. FIG. 4A to FIG. 4D are partial enlarged views of the vicinity of the outer electrode of the schematic section along line A-A in FIG. 2, and are diagrams for explaining the respective steps.

Coil Preparing Step

In the coil preparing step, a coil is prepared that is formed by winding a conductor wire having an insulating coating on a surface thereof, and having a substantially rectangular-shaped cross-section orthogonal to a length direction, such that an lead-out portion is extended from an outermost periphery of a winding portion, to form two tiers so as to be connected to each other at an innermost periphery. A flat portion is provided on an end portion of the lead-out portion on a surface continuous with an outermost peripheral surface of the winding portion.

Body Molding Step

Figure 4A:
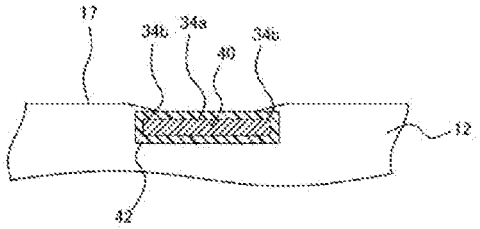
FIGS. 4A to 4D are schematic sectional views illustrating a method for forming an outer electrode of the inductor according to Example 1.

In the body molding step, the prepared coil is embedded in a magnetic portion material obtained by kneading a magnetic powder and a thermosetting resin, and pressing and heating are performed to form a substantially rectangular parallelepiped shape. Thus, a body is obtained in which a winding axis of the winding portion is disposed in the magnetic portion 12 so as to intersect substantially perpendicularly to a mounting surface of the body, and an end portion of the lead-out portion is disposed along an end surface adjacent to the mounting surface. At this time, as illustrated in FIG. 4A, on the end surface 17, an insulating coating 42 on the flat portion 34*a* provided at a center portion in a line-width direction of the conductor wire 40 is exposed from the end surface 17, and the covered portions 34*b* provided at both end portions respectively in the line-width direction are embedded in the body so as to be covered with the magnetic portion 12 constituting the end surface 17.

External Resin Film Forming Step

Figure 4B:
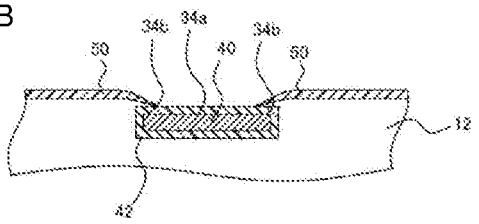

As illustrated in FIG. 4B, the external resin film 50 having insulation properties is formed in another region of a surface of the molded body from which the insulating coating 42 is not exposed. The external resin film 50 is formed, for example, by adding a thermosetting resin such as an epoxy resin, a polyimide resin, or a phenol resin, or a thermoplastic resin such as a polyethylene resin or a polyamide resin to a surface by a measure such as application or dipping, and by curing the added resin as necessary.

Peeling Step

Figure 4C:
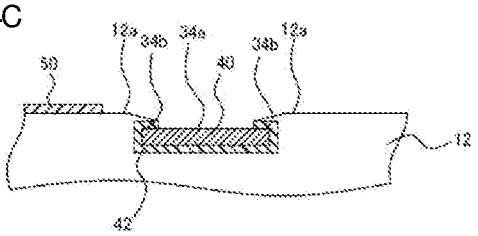

In the peeling step, as illustrated in FIG. 4C, the external resin film 50 and the insulating coating 42 of the conductor wire are removed to expose the flat portion 34*a* of the conductor wire 40 to the end surface 17 of the body. A range from which an external resin is peeled off is a range having an L-shaped section extending across the mounting surface 15 and the end surface 17, and corresponding to the outer electrode 20 in FIG. 1. For removing the external resin film 50 and the insulating coating 42 of the conductor wire, for example, laser irradiation is applied. By the laser irradiation, a portion of the insulating coating 42 on the flat portion 34*a* of the conductor wire 40 and the adjacent external resin film 50 are removed, and the flat portion 34*a* of the conductor wire 40 is exposed from the end surface 17. The insulating coating 42 on the covered portion 34*b* of the conductor wire is covered with the magnetic portion 12 and thus is not removed and remains.

With the removal of the external resin film 50 covering the body, a resin component in the magnetic portion 12 is removed to form a magnetic portion exposed portion 12*a* in which the magnetic powder in the magnetic portion 12 is exposed to the surface of the body. Further, on a surface of the magnetic portion exposed portion 12*a*, the magnetic powders are melted and fused to each other to form network structure in which the magnetic powders are connected to each other in a network. By forming the magnetic portion exposed portion 12*a* having the relatively wide network structure on the surface of the body having the L-shaped section extending across the mounting surface 15 and the end surface 17, for example, contact opportunities between a plated layer and a medium increase during barrel plating, and a growth rate of the plated layer is improved. Further, since both the edge portions of the conductor wire in the width direction are covered with the magnetic portion, generation of a residue of the insulating coating accompanying the removal of the insulating coating of the conductor wire, and generation of a groove portion due to excessive removal of the insulating coating are suppressed.

Outer Electrode Forming Step

Figure 4D:
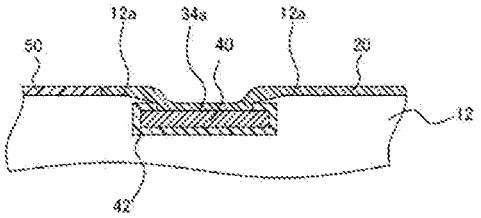

In the outer electrode forming step, as illustrated in FIG. 4D, a plated layer is formed on each of the magnetic portion exposed portion 12*a* and the flat portion 34*a* of the conductor wire 40, for example, by a plating process. The respective plated layers, due to growing of plating, are integrated and electrically connected to each other to form the outer electrode 20. The plating process may include, for example, a step of plating a surface of the body 10 by copper plating, a subsequent nickel plating step, a tin plating step, and the like.

In the outer electrode forming step, the generation of the residue of the insulating coating and the generation of the groove portion are suppressed between the flat portion of the conductor wire and the magnetic portion exposed portion on the surface of the body. Thus, discontinuity of the flat portion and the plated layer formed on the magnetic portion exposed portion is minimized or reduced, and occurrence of connection failure between the coil and the outer electrode is suppressed even when the plated layer is thin. Further, since it is not necessary to make a plating thickness larger than necessary for connecting the end portion of the lead-out portion of the coil to the outer electrode, productivity is improved. Further, when the plating process is performed by barrel plating, a time required for the plating process is reduced, so that damage to the external resin film can be reduced. Further, the generation of the residue and the groove can be suppressed to make an allowable range of a laser irradiation condition wider for removing the insulating coating of the conductor wire, and further, the productivity can be improved.

Comparative Example 1

An inductor according to Comparative example 1 is described with reference to FIG. 5A to FIG. 5C and FIG. 6A to FIG. 6C. FIG. 5A to FIG. 5C and FIG. 6A to FIG. 6C are partial enlarged views of the vicinity of the outer electrode in a schematic sectional view taken along line A-A in FIG. 2 that illustrate a method for forming the outer electrode as enlarged views. The inductor according to Comparative example 1 is configured in the same manner as the inductor according to Example 1 except that a covered portion is not provided at both end portions in a line-width direction of an lead-out portion.

Figure 5A:
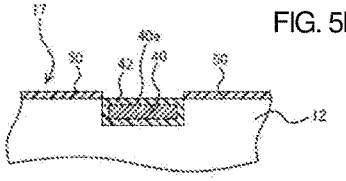
FIGS. 5A to 5C are schematic sectional views illustrating a method for forming an outer electrode of an inductor according to Comparative example 1.
Figure 6A:
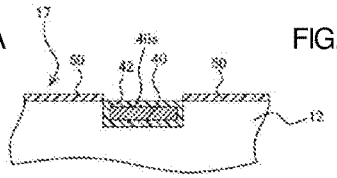
FIGS. 6A to 6C are schematic sectional views illustrating another example of the method for forming the outer electrode of the inductor according to Comparative example 1.

FIG. 5A and FIG. 6A illustrate a state after an external resin film forming step. As illustrated in FIG. 5A and FIG. 6A, in the lead-out portion 34, the insulating coating 42 on a wide surface 40*a* of the conductor wire 40 is exposed from an end surface of a body 10, and another area on a surface of the body 10 from which the insulating coating is not exposed is covered with the external resin film 50.

Figure 5B:
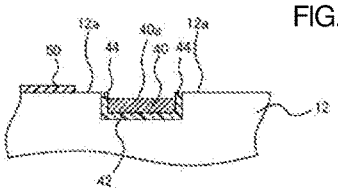
Figure 6B:
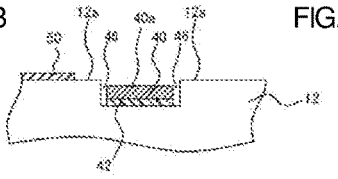

FIG. 5B and FIG. 6B illustrate a state after a peeling step. As illustrated in FIG. 5B, the insulating coating 42 disposed on the wide surface 40*a* of the conductor wire 40 is removed by laser irradiation, so that the wide surface 40*a* of the conductor wire 40 is exposed from the end surface 17. On the other hand, as for the insulating coating 42 covering a side surface of the conductor wire 40, the conductor wire 40 is not present under the insulating coating 42, removal efficiency for the insulating coating 42 by the laser irradiation is lowered, so that a residue 44 of the insulating coating 42 is generated. Further, at least a portion of the external resin film 50 is removed to form the magnetic portion exposed portion 12*a* on the surface of the body 10. The residue 44 exists between the wide surface 40*a* and the magnetic portion exposed portion 12*a*.

Figure 5C:
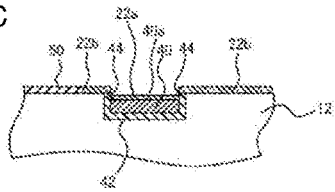

FIG. 5C illustrates a state during an outer electrode forming step. As illustrated in FIG. 5C, a plated layer 22*a* is formed on the wide surface 40*a* of the conductor wire by the plating process, and a plated layer 22*b* is formed on the magnetic portion exposed portion 12*a* on the surface of the body 10. Since each plated layer grows also in a lateral direction, the wide surface 40*a* and the magnetic portion exposed portion 12*a* are to be integrated with each other with a certain degree of plating thickness. Here, since the plated layer 22*a* on the wide surface 40*a* and the plated layer 22*b* on the magnetic portion exposed portion 12*a* are separated by the residue 44, when a thickness of the plated layer 22*a* is not large, connection failure occurs between a coil and the outer electrode.

Further, as illustrated in FIG. 6B, the insulating coating 42 on the wide surface 40*a* of the lead-out portion is removed by the laser irradiation, so that the wide surface 40*a* of the conductor wire 40 is exposed from the end surface 17. Depending on a laser irradiation condition, the insulating coating 42 on the side surface of the conductor wire 40 is removed excessively, and a groove 46 is generated. Further, at least a portion of the external resin film 50 is removed to form the magnetic portion exposed portion 12*a* on the surface of the body 10. The groove 46 exists between the wide surface 40*a* and the magnetic portion exposed portion 12*a*.

Figure 6C:
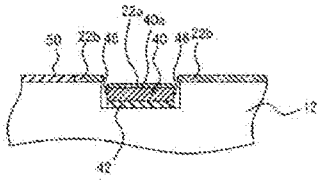

FIG. 6C illustrates a state during the outer electrode forming step. As illustrated in FIG. 6C, the plated layer 22*a* is formed on the wide surface 40*a* and the side surface of the conductor wire by the plating process, and the plated layer 22*b* is formed on the magnetic portion exposed portion 12*a* on the surface of the body 10. Since each plated layer grows not only in a thickness direction but also in the lateral direction, the plated layer 22*a* formed on the wide surface 40*a* and the plated layer 22*b* formed on the magnetic portion exposed portion 12*a* are to be integrated with each other with a certain degree of plating thickness. Here, since plating is difficult to grow in the groove 46 between the plated layer 22*a* on the wide surface 40*a* and the plated layer 22*b* on the magnetic portion exposed portion 12*a*, connection failure occurs between the coil and the outer electrode unless the thickness of the plated layer is increased.

Example 2

Figure 7A:
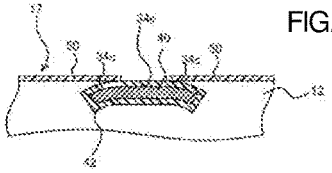
FIGS. 7A to 7C are schematic sectional views illustrating a method for forming an outer electrode of an inductor according to Example 2.
Figure 7B:
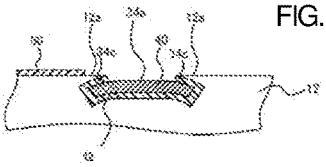
Figure 7C:
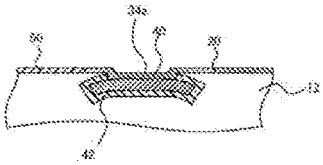

An inductor according to Example 2 is described with reference to FIG. 7A to FIG. 7C. FIG. 7A to FIG. 7C are partial enlarged views of the vicinity of the outer electrode in the schematic sectional view taken along line A-A in FIG. 2, FIG. 7A illustrates a state after an external resin film forming step, FIG. 7B illustrates a state after a peeling step, and FIG. 7C illustrates a state after an outer electrode forming step. The inductor according to Example 2 is configured in the same manner as the inductor according to Example 1 except that at least a portion of a covered portion at an end portion of an lead-out portion is disposed further inside a body than a flat portion.

As illustrated in FIG. 7A, a covered portion 34*c* is formed at both edge portions of the flat portion 34*a* in a width direction of the conductor wire 40, and the edge portions of the conductor wire 40 in the width direction are bent toward an inner direction of the body 10 to be embedded in the magnetic portion 12. That is, the covered portion 34*c* is disposed further inside the body 10 than the flat portion 34*a*, that is, at a position where a distance from the end surface 17 is larger than that from the flat portion 34*a*.

As illustrated in FIG. 7B, the insulating coating 42 on the flat portion 34*a* of the conductor wire 40 is removed by the laser irradiation, so that the flat portion 34*a* of the conductor wire 40 is exposed from the end surface. Also, a portion of the external resin film 50 adjacent to the flat portion 34*a* is removed as well. In addition, a resin component in a magnetic portion on the magnetic portion 12 is removed to form the magnetic portion exposed portion 12*a* in which a magnetic powder in the magnetic portion is exposed to a surface of the body 10. The magnetic portion exposed portion 12*a* and the covered portion 34*c* are adjacent to each other at different levels with the insulating coating 42 interposed therebetween.

As illustrated in FIG. 7C, a plated layer is formed across the magnetic portion exposed portion 12*a* on the surface of the body 10 and the covered portion 34*c* and the flat portion 34*a* of the conductor wire 40 by a plating process, thereby electrically connecting a coil and the outer electrode 20.

In the inductor according to Example 2, for example, the coil having a shape in which both edge portions of the flat portion 34*a* are bent in an inner direction of the body 10 is embedded in the magnetic portion 12, at the end portion of the lead-out portion. Thus, structure can easily be realized in which the flat portion 34*a* is exposed from the end surface of the body 10, and the covered portion 34*c* is covered with the magnetic portion 12. Further, although the covered portion 34*c* has a curved surface, the covered portion 34*c* may have a flat surface portion at least in a portion thereof.

Figure 8A:
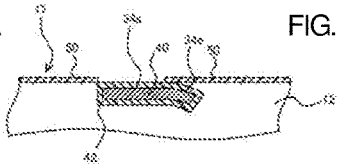
FIGS. 8A to 8C are schematic sectional views illustrating a method for forming an outer electrode in a modification of the inductor according to Example 2.
Figure 8B:
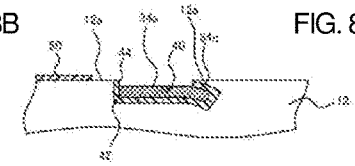
Figure 8C:
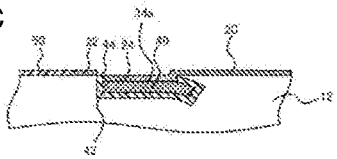

A modification of the inductor according to Example 2 is described with reference to FIG. 8A to FIG. 8C. FIG. 8A to FIG. 8C are partial enlarged views of the vicinity of the outer electrode in the schematic sectional view taken along line A-A in FIG. 2, FIG. 8A illustrates a state after an external resin film forming step, FIG. 8B illustrates a state after a peeling step, and FIG. 8C illustrates a state after an outer electrode forming step. The modification of the inductor according to Example 2 is configured in the same manner as the inductor according to Example 2 except that a covered portion is formed only at one edge portion in a width direction of a conductor wire.

As illustrated in FIG. 8A, the covered portion 34*c* is formed on the one edge portion of the flat portion 34*a* in the width direction of the conductor wire 40, and is disposed further inside a body 10 than the flat portion 34*a*. In addition, another edge portion is not formed with a covered portion.

As illustrated in FIG. 8B, the insulating coating 42 on the flat portion 34*a* of the conductor wire 40 is removed by laser irradiation, so that the flat portion 34*a* of the conductor wire 40 is exposed from an end surface. Also, a portion of the external resin film 50 adjacent to the flat portion 34*a* is removed as well. At this time, at the other edge portion of the flat portion 34*a* in the width direction of the conductor wire 40, the residue 44 is generated depending on a laser irradiation condition. Further, at the end surface 17 of the body 10, at least a portion of the external resin film 50 is removed to form the magnetic portion exposed portion 12*a* on a surface of the body 10. Although FIG. 8B illustrates a case in which the residue 44 is generated, a groove portion may be formed by the laser irradiation.

As illustrated in FIG. 8C, by a plating process, a plated layer is formed across the magnetic portion exposed portion 12*a* on the surface of the body 10 and the covered portion 34*c* and the flat portion 34*a* of the conductor wire 40, at the one edge portion of the flat portion 34*a*. Further, on the other edge portion of the flat portion 34*a*, the plated layer 22 on the magnetic portion exposed portion 12*a* and a plated layer 24 formed on the flat portion 34*a* are separated by the residue 44. As described above, when only one side of both the edge portions of the flat portion is bent to form the covered portion, there is a possibility that a residue is generated on one edge portion or a possibility that a groove is generated, but there is no possibility that a residue or a groove is generated on another edge portion, so that a coil and the outer electrode 20 are reliably connected to each other by the plating process.

Example 3

Figure 9A:
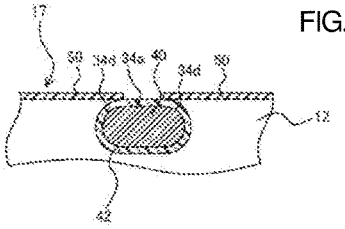
FIGS. 9A to 9C are schematic sectional views illustrating a method for forming an outer electrode of an inductor according to Example 3.
Figure 9B:
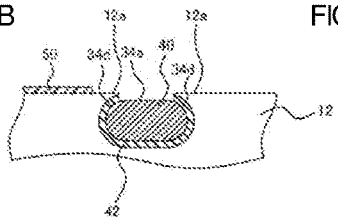
Figure 9C:
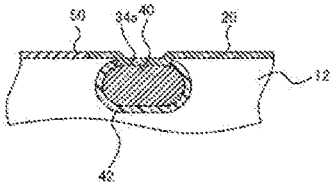

An inductor according to Example 3 is described with reference to FIG. 9A to FIG. 9C. FIG. 9A to FIG. 9C are schematic sectional views taken along line A-A in FIG. 2, FIG. 9A illustrates a state after an external resin film forming step, FIG. 9B illustrates a state after a peeling step, and FIG. 9C illustrates a state after an outer electrode forming step. The inductor according to Example 3 is configured in the same manner as the inductor according to Example 1 except that a cross-section orthogonal to a length direction of the conductor wire 40 has a substantially elliptical shape.

As illustrated in FIG. 9A, a covered portion 34*d* is formed in a substantially circular arc shape continuous with both edge portions of the flat portion 34*a*, and is covered with the magnetic portion 12. An end portion of an lead-out portion having a substantially oval section can be formed by forming a winding portion of a coil by using, for example, a conductor wire having a substantially circular section, and crushing the conductor wire at the end portion of the lead-out portion. Further, in FIG. 9A, the respective flat portions 34*a* are formed on both sides, that is, a side from which the end portion of the lead-out portion is exposed and a side opposed thereto, but the flat portion 34*a* may be formed only on the side from which the end portion of the lead-out portion is exposed.

As illustrated in FIG. 9B, the insulating coating 42 on the flat portion 34*a* of the conductor wire 40 is removed by laser irradiation, so that the flat portion 34*a* of the conductor wire 40 is exposed from an end surface. Also, a portion of the external resin film 50 on the covered portion 34*d* adjacent to the flat portion 34*a*, the magnetic portion 12, and the insulating coating 42 is removed, and a portion of the covered portion 34*d* is exposed from the end surface. At least a portion of the external resin film 50 on the magnetic portion is removed, the magnetic portion exposed portion 12*a* is formed on a surface of a body 10, and the magnetic portion exposed portion 12*a* and the covered portion 34*c* are adjacent to each other with the insulating coating 42 interposed therebetween.

As illustrated in FIG. 9C, a plated layer is formed across the magnetic portion exposed portion 12*a* on the surface of the body 10, the insulating coating 42 of the covered portion

34*d* and the flat portion 34*a* of the conductor wire 40 by a plating process, thereby electrically connecting the coil and the outer electrode 20.

In the inductor according to Example 3, for example, a substantially circular line having a substantially circular section is crushed at the end portion of the lead-out portion to form the flat portion 34*a*, whereby the covered portion 34*d* having a substantially circular arc section is formed, so that structure can be easily formed in which the flat portion 34*a* is exposed from an end surface of the body 10, and the covered portion 34*c* is covered with the magnetic portion 12.

Example 4

Figure 10:
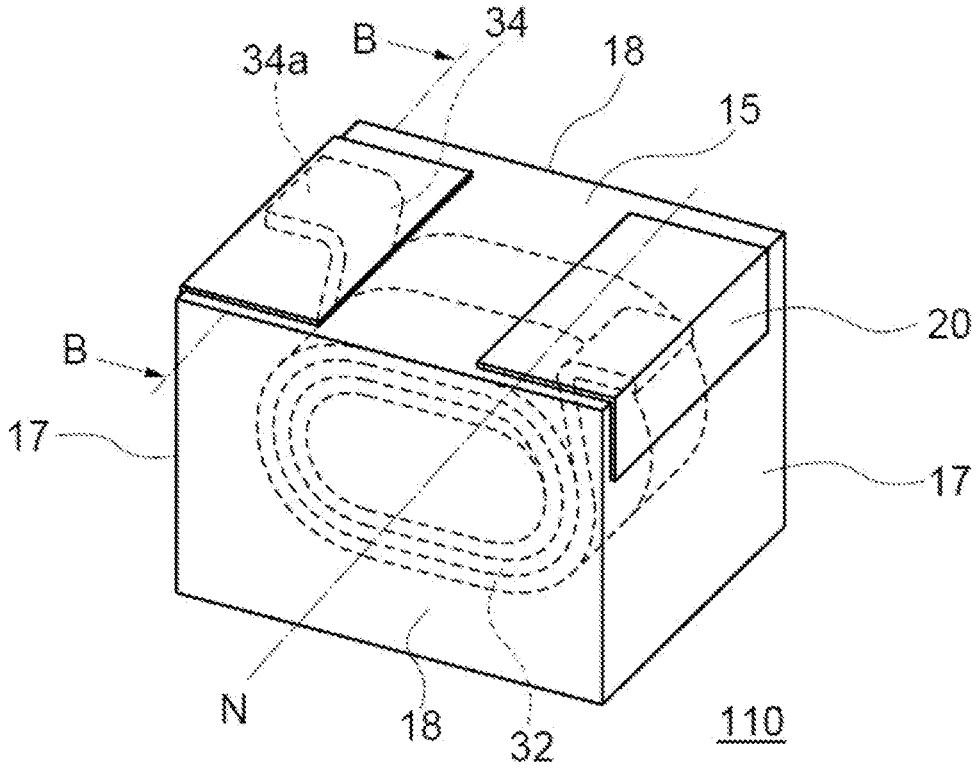
FIG. 10 is a partial see-through perspective view of an inductor according to Example 4 as viewed from a side of a mounting surface.

An inductor 110 according to Example 4 is described with reference to FIG. 10. FIG. 10 is a schematic partial see-through perspective view of the inductor 110 as viewed from a side of a mounting surface. The inductor 110 is configured in the same manner as the inductor according to Example 1 except that the winding portion 32 of a coil is contained in a body 10 such that a winding axis N does not intersect the mounting surface 15 and is substantially parallel to the mounting surface 15, and that an end portion of the lead-out portion 34 of the coil is exposed from the mounting surface 15.

In the inductor 110, each of the lead-out portions 34 is extended from an outermost periphery of the winding portion 32 in a direction of the mounting surface 15, and the end portions of the respective lead-out portions 34 are bent so as to be substantially parallel to the mounting surface 15 and opposite to each other, and are exposed from the mounting surface 15. The end portion of the lead-out portion 34 in a section (section B-B) along line B-B in FIG. 10 and parallel to the end surface 17, as illustrated in Examples 1 to 3, is provided with the flat portion 34*a* and a covered portion. The outer electrode 20 is disposed across the mounting surface 15 and the end surface 17 of the body 10. In the inductor 110, since the flat portion 34*a* of the lead-out portion is directly exposed from the mounting surface, DC resistance is reduced.

Example 5

Figure 11:
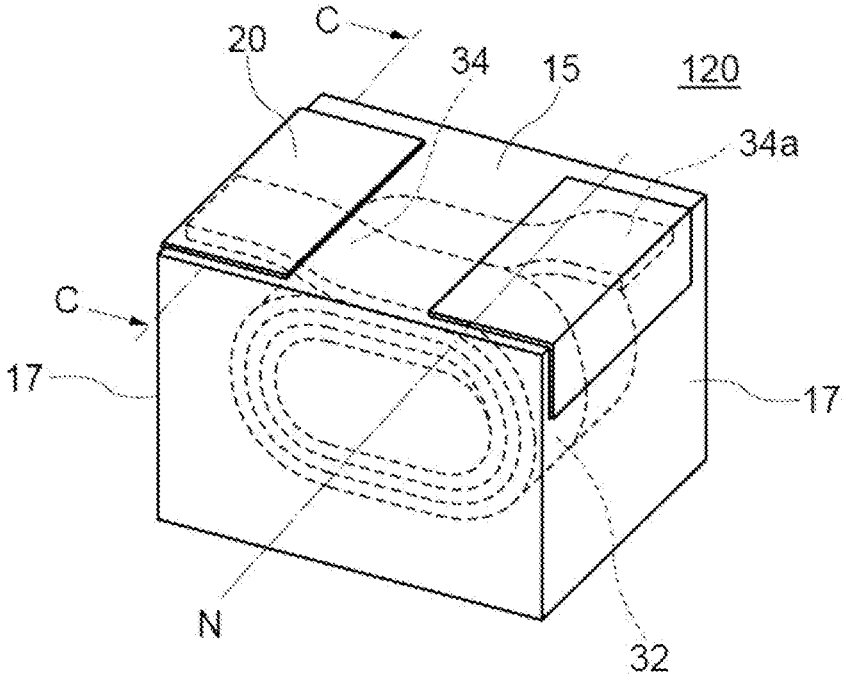
FIG. 11 is a partial see-through perspective view of an inductor according to Example 5 as viewed from a side of a mounting surface.

An inductor 120 according to Example 5 is described with reference to FIG. 11. FIG. 11 is a schematic partial see-through perspective view of the inductor 120 as viewed from a side of a mounting surface. The inductor 120 is configured in the same manner as the inductor according to Example 4 except that the lead-out portions 34 of a coil are extended in a direction of the mounting surface 15 so as to intersect each other, when viewed from a direction of the winding axis N.

An end portion of the lead-out portion in a section along line C-C in FIG. 11, as illustrated in Examples 1 to 3, is provided with the flat portion 34*a* and a covered portion. Since an angle at which a leading end of the lead-out portion is bent need not be large in the inductor 120, deformation of the lead-out portion can be reduced, thereby improving reliability of the lead-out portion.

Example 6

Figure 12:
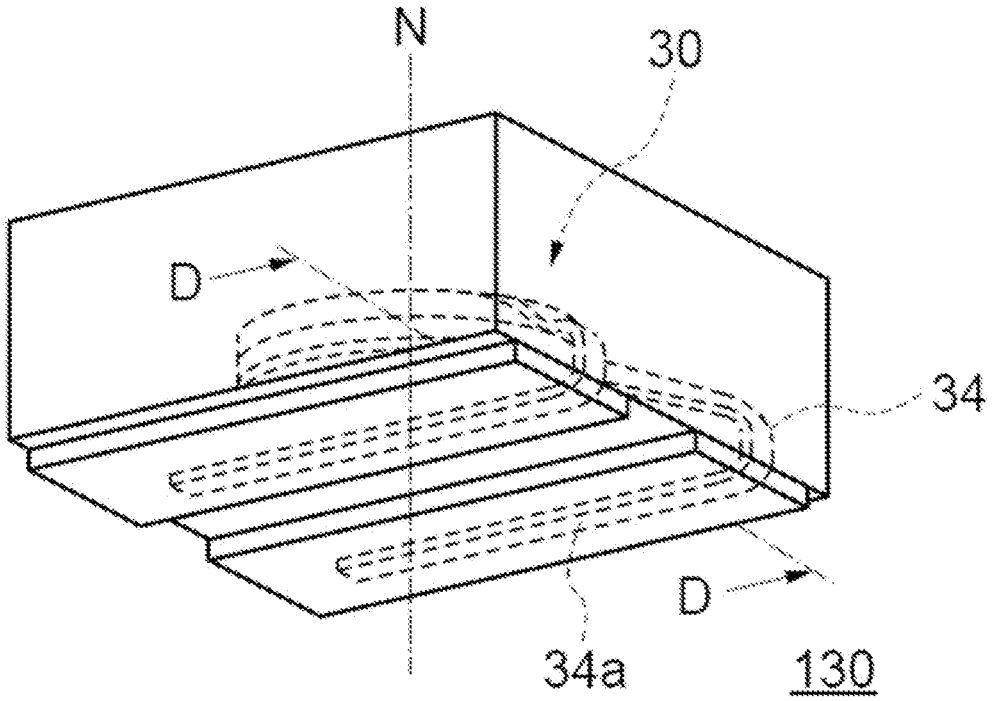
FIG. 12 is a partial see-through perspective view of an inductor according to Example 6 as viewed from a side of a mounting surface.

An inductor 130 according to Example 6 is described with reference to FIG. 12. FIG. 12 is a schematic partial see-through perspective view of the inductor 130 as viewed from a side of a mounting surface. The inductor 130 is configured in the same manner as the inductor according to Example 1 except that a winding portion of a coil is formed by winding a conductor wire having a substantially circular section, the lead-out portion 34 of the coil is extended in a direction of one end surface of a body 10, and is bent so that the flat portion 34*a* at an end portion of the lead-out portion is exposed from the mounting surface, and an outer electrode is disposed only on the mounting surface.

In the inductor 130, the coil 30 is formed by winding the conductor wire having the substantially circular section, and the flat portion 34*a* is formed by crushing, for example, the conductor wire at the end portion of the lead-out portion. Accordingly, as illustrated in Example 3, the flat portion and a covered portion can be formed more easily, at the end portion of the lead-out portion in a section D-D in FIG. 12. Further, since the flat portion 34*a* of the lead-out portion 34 is directly exposed from the mounting surface, it is possible to provide an inductor that has small DC resistance and can support high density implementation.

Example 7

Figure 13:
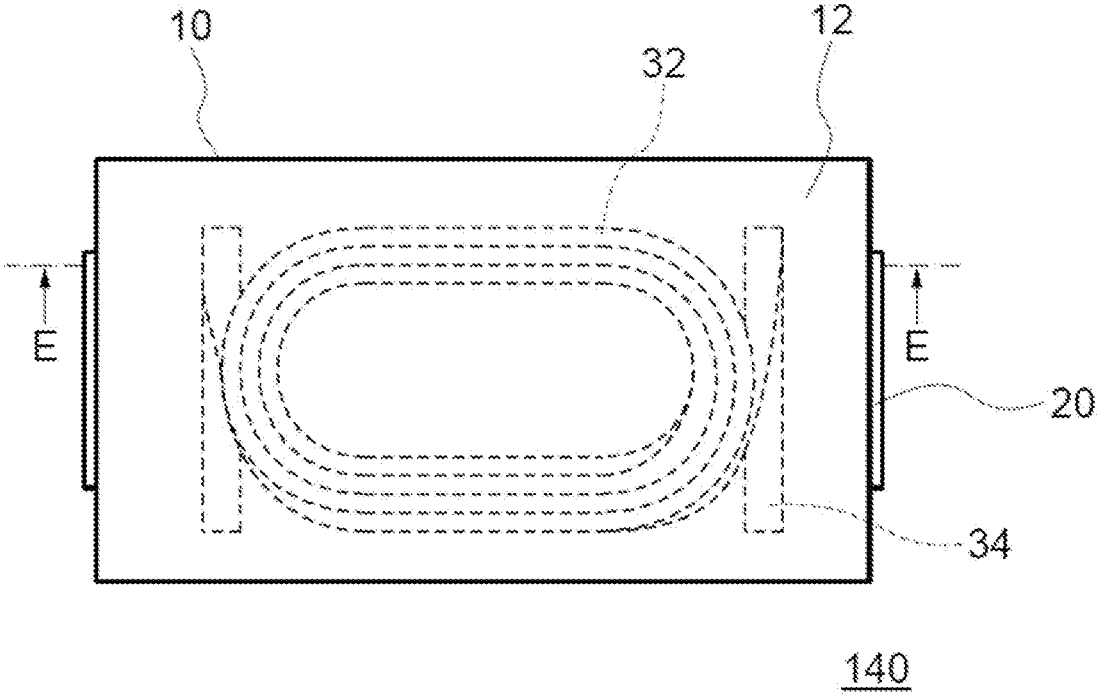
FIG. 13 is a partial see-through plan view of an inductor according to Example 7 as viewed from a side of an upper surface.

An inductor 140 according to Example 7 is described with reference to FIG. 13. FIG. 13 is a schematic partial see-through plan view of the inductor 140 as viewed from an upper surface side opposite a mounting surface. The inductor 140 is configured in the same manner as the inductor according to Example 1 except that the lead-out portion 34 of a coil is extended in a direction of one side surface of a body 10, and is bent so that a flat portion of an end portion of the lead-out portion is exposed from the mounting surface.

In the inductor 140, the lead-out portion 34 of the coil is extended while being twisted in the direction of the one side surface of the body 10 so that a wide surface is parallel to the mounting surface, and is bent approximately 180°, so that the flat portion is exposed from the mounting surface. Also, the outer electrodes 20 extend over the mounting surface as shown, for example, in FIG. 1. Then, as illustrated in Examples 1 to 3, the flat portion and a covered portion are provided at the end portion of the lead-out portion in a section E-E in FIG. 13. In the inductor 140, since the end portion of the lead-out portion is directly exposed from the mounting surface, DC resistance is reduced.

In the above Examples, the body has a substantially rectangular parallelepiped shape, but sides forming the substantially rectangular parallelepiped shape may be chamfered.

Further, the winding direction of the winding portion of the coil may be wound counterclockwise when viewed from the upper surface side. The winding portion of the coil may have a substantially circular shape, a substantially oval shape, a substantially elliptical shape, a substantially polygonal shape, or the like as viewed from the winding axis direction. The covered portion adjacent to the flat portion may be provided with at least one of the end portions.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An inductor comprising:

a body including:

a coil including a winding portion formed by winding a conductor wire having an insulating coating and lead-out portions extended from the winding portion in a length direction of the conductor wire, the length direction being a direction along the conductor wire from one of the lead-out portions at one end of the conductor wire to an other of the lead-out portions at an other end of the conductor wire; and a magnetic portion including a magnetic powder and a resin; and outer electrodes disposed on a surface of the body, which are electrically connected to the coil, wherein the body includes a mounting surface, an upper surface opposite to the mounting surface, a pair of end surfaces disposed adjacent to the mounting surface and the upper surface and opposite to each other, and a pair of side surfaces disposed adjacent to the mounting surface, the upper surface, and the end surfaces and opposite to each other, end portions of the lead-out portions respectively have:

a flat portion exposed from one of the surfaces of the body, and a covered portion adjacent to the flat portion, which is covered with the magnetic portion, the flat portion is electrically connected to the outer electrode, a winding axis of the winding portion is substantially parallel to the mounting surface, and the flat portion at the end portion of the lead-out portion is exposed from the mounting surface, and along a line extending in a width direction across the conductor wire perpendicular to the length direction of the conductor wire, at least one of the edges of the conductor wire intersected by the line is further inside the body than the flat portion at a center of the conductor wire where the flat portion is intersected by the line, and the at least one of the edges extends transverse to the length and width directions.

2. The inductor according to claim 1, wherein the flat portion extends in a width direction of the conductor wire, the width direction being transverse to the length direction, the covered portion includes at least one edge side of the flat portion in the width direction of the conductor wire, at least part of the covered portion is disposed further inside the body than the flat portion by the at least one edge side in the width direction of the conductor wire bent an inner direction of the body, the flat portion is disposed further inside the body than the one of the surfaces of the body and is connected to the outer electrode, and the outer electrode has a recessed portion along the flat portion.

3. The inductor according to claim 1, wherein the outer electrode includes a plated layer connected to the flat portion and disposed on the surface of the body where the flat portion is exposed, and the magnetic powder includes metal magnetic substances, and at least some of the metal magnetic substances of the covered portion on the surface of the body where the plated layer is formed are fused to each other.

4. An inductor comprising:

a body including:

a coil including a winding portion formed by winding a conductor wire having an insulating coating and lead-out portions extended from the winding portion in a length direction of the conductor wire, the length direction being a direction along the conductor wire from one of the lead-out portions at one end of the conductor wire to an other of the lead-out portions at an other end of the conductor wire; and a magnetic portion including a magnetic powder and a resin; and outer electrodes disposed on a surface of the body, which are electrically connected to the coil, wherein the body includes a mounting surface, an upper surface opposite to the mounting surface, a pair of end surfaces disposed adjacent to the mounting surface and the upper surface and opposite to each other, and a pair of side surfaces disposed adjacent to the mounting surface, the upper surface, and the end surfaces and opposite to each other, end portions of the lead-out portions respectively have:

a flat portion exposed from one of the surfaces of the body, and a covered portion adjacent to the flat portion, which is covered with the magnetic portion, the flat portion is electrically connected to the outer electrode, the flat portion extends in a width direction of the conductor wire, the width direction being transverse to the length direction, the covered portion includes at least one edge side of the flat portion in a width direction of the conductor wire, at least part of the covered portion is disposed further inside the body than the flat portion by the at least one edge side in the width direction of the conductor wire bent an inner direction of the body, the flat portion is disposed further inside the body than the surfaces of the body and is connected to the outer electrode, the outer electrode has a recessed portion along the flat portion, a winding axis of the winding portion intersects the mounting surface, and the flat portion at the end portion of the lead-out portion is exposed from the end surfaces of the body which are opposite to each other, and along a line extending in a width direction across the conductor wire perpendicular to the length direction of the conductor wire, at least one of the edges of the conductor wire intersected by the line is further inside the body than the flat portion at a center of the conductor wire where the flat portion is intersected by the line, and the at least one of the edges extends transverse to the length and width directions.

5. An inductor comprising:

a body including:

a coil including a winding portion formed by winding a conductor wire having an insulating coating and lead-out portions extended from the winding portion, the length direction being a direction along the conductor wire from one of the lead-out portions at one end of the conductor wire to an other of the lead-out portions at an other end of the conductor wire; and a magnetic portion including a magnetic powder and a resin; and outer electrodes disposed on a surface of the body, which are electrically connected to the coil, wherein the body includes a mounting surface, an upper surface opposite to the mounting surface, a pair of end surfaces disposed adjacent to the mounting surface and the upper surface and opposite to each other, and a pair of side surfaces disposed adjacent to the mounting surface, the upper surface, and the end surfaces and opposite to each other, end portions of the lead-out portions respectively have:

a flat portion exposed from one of the surfaces of the body, and a covered portion adjacent to the flat portion, which is covered with the magnetic portion, the flat portion is electrically connected to the outer electrode, a winding axis of the winding portion intersects the mounting surface, and the flat portion at the end portion of the lead-out portion is exposed from the mounting surface, and along a line extending in a width direction across the conductor wire perpendicular to the length direction of the conductor wire, at least one of the edges of the conductor wire intersected by the line is further inside the body than the flat portion at a center of the conductor wire where the flat portion is intersected by the line, and the at least one of the edges extends transverse to the length and width directions.

6. The inductor according to claim 2, wherein the at least part of the covered portion has a curved surface.

7. The inductor according to claim 4, wherein one of the lead-out portions extends toward one of the end surfaces and the other of the lead-out portions extends toward the other of the end surfaces.

8. The inductor according to claim 4, wherein one of the lead-out portions extends from a location in the body overlapping one of the outer electrodes disposed at one of the end surfaces toward the other of the end surfaces, and the other of the lead-out portions extends from a location in the body overlapping the other of the outer electrodes disposed at the other of the end surfaces toward the one of the end surfaces.

9. The inductor according to claim 4, wherein the lead-out portions extend in a direction toward one of the end surfaces.

10. The inductor according to claim 2, wherein the outer electrode includes a plated layer connected to the flat portion and disposed on the surface of the body where the flat portion is exposed, and the magnetic powder includes metal magnetic substances, and at least some of the metal magnetic substances of the covered portion on the surface of the body where the plated layer is formed are fused to each other.

* * * * *